US006497317B1

(12) United States Patent
Chun

(10) Patent No.: US 6,497,317 B1
(45) Date of Patent: Dec. 24, 2002

(54) ROOF AND RAIN GUTTER CLEANING TOOLS

(76) Inventor: Andrew Chun, 8106 215th Place SW., Edmonds, WA (US) 98026

( * ) Notice: Subject to any disclaimer, the term of this patent is extended or adjusted under 35 U.S.C. 154(b) by 0 days.

(21) Appl. No.: 09/940,214

(22) Filed: Aug. 28, 2001

(51) Int. Cl.[7] ..... B65G 11/10

(52) U.S. Cl. ..... 193/25 R; 401/266; 401/261; 401/139

(58) Field of Search ..... 232/43.1, 43.2, 232/43.3, 43.4, 43.5; 193/25 R, 4, 5; 220/908.3; 401/135, 261

(56) References Cited

U.S. PATENT DOCUMENTS 913,117 A * 2/1909 Feyma ..... 193/25 R
1,633,341 A * 6/1927 McDonald ..... 193/4
2,772,764 A * 12/1956 McClellan ..... 193/4
3,261,441 A * 7/1966 Mullens ..... 193/33
4,798,028 A * 1/1989 Pinion ..... 52/16
4,837,987 A * 6/1989 Pender ..... 52/11

* cited by examiner

*Primary Examiner*—Gregory Huson
*Assistant Examiner*—Huyen Le

(57) ABSTRACT

The Roof-Rain Gutter Cleaning Tools which are comprised of two parts such as the rain gutter cleaning devices to clean fallen leaves and twigs from the rain gutter and the plate rake consisting of telescopic fiberglass rod for cleaning roof surfaces which also function jet water flashing by manipulating faucet provided at the rear end of the fiberglass rod that is connected with the water hose; As such that, the roof surfaces and rain gutter cleaning operation is performed with use of ladder the top step of which is safely tightened with rope to a gutter hanger strap whereby the cleaning person climb up to nearby the rain gutter wherein the hanger panel of the debris dispensing inlet unit is set up on the outer wall of the rain gutter while linking the inlet unit with the debris-leaves transmission tube the lower end of which fixed with plastic bucket.

1 Claim, 3 Drawing Sheets

4-a
4-b
4-c
4-d
4-e
4-f 3-a
3-b
3-c
3-d
3-e
3-f
3-g 1-a
1-b
1-c
1-d
1-e 2-a
2-b
2-c
2-d

ROOF AND RAIN GUTTER CLEANING TOOLS

BACKGROUND OF THE INVENTION

This invention is very much concerned about the practical possibility wherein the rain gutter cleaning job should be done along with the cleaning of debris, twigs and leaves scattered over the roof surfaces and valleys, and at the same time it can be done in washing down the surfaces of the roof, valleys and rain gutters of the house. In order to achieve complete cleaning job of the roof and rain gutter, the instant invention is designed to utilize the debris-leaves disposal system in combination with the raking device which is also possible washing down roof and rain gutter by means of connecting water hose to the rear end of the hollow fiberglass rod which is devised with a faucet and female threaded therein to connect with the water hose for the final cleaning operation of the roof and rain gutter.

In addition, this invention is regarded that all individual elements for the said cleaning devices could be easily assembled and activated, while assuring that the cleaning job could be performed in keeping the ground surface underneath the rain gutters around the house from scattering unwanted debris, twigs and leaves, while prospecting inexpensive supply to the consumers.

Udelle, in U.S. Pat. No. 5,875,590, describes that Rain gutter leaf guard and cleaning device is comprised with typical rain gutter, leaf guard assembly, angled top long pole and female threaded means to connect with garden hose on the end wall of the leaf guard assembly with meshed cover hinged on top of outer wall of the rain gutter, and the device is manipulated with the long pole to open or close the leaf guard assembly. Maraschielio, in U.S. Pat. No. 5,855,402, describes the rain gutter cleaning tool, wherein the gutter cleaning tool is devised with operating gripper jaw mechanism at the forward end of a long pole with a fixed handle at the rear end having means manipulating the gripper jaw grappling debris and leaves on the rain gutter which is activated on the ground level.

McDermott, U.S. Pat. No. 5,853,209, which describes angle adjustable rain gutter cleaning apparatus to be operated from the ground level wherein the debris gripper jaw is activated to pick up debris and leaves from the rain gutter selectively by means of cable control. Morrow, in U.S. Pat. No. 4,972,863, wherein the rain gutter cleaner is operated by attaching it to the existing rain gutter and then connecting it to the water hose. U.S. Pat. No. 4,958,397 and U.S. Pat. No. 4,238,866 are described wherein they are operated by means of electricity or motor power for rain gutter cleaning.

Also referenced with are:

U.S. Pat. No. 5,960,590

U.S. Pat. No. 5,896,706

U.S. Pat. No. 5,957,585

U.S. Pat. No. 5,893,239

U.S. Pat. No. 5,916,092

SUMMARY OF THE INVENTION

This invention is centered to make perfect cleaning job of roof and rain gutters of a house such that it is necessary appropriately install ladder with the topmost step tightened to a rain gutter hanger strap with rope, and then the debris dispensing inlet is set up at the outer wall of the rain gutter by clinging therein with the folding panel. The debris dispensing inlet is then connected with the debris transmission tube by hooking up by means of the hooking devices provided respectively on outside walls of the rectangular lower portion of the debris dispensing inlet and the rectangular connector at the top of the transmission tube.

Similarly installed is the bucket which is hooked up at the lower end of the transmission tube. To begin with the cleaning job, the debris, twigs and leaves on the roof and valley must be raked down to the rain gutter with use of the right-angled rake which is fixedly installed at the forward end of the telescopic hollow fiberglass rod that is extendible to a point near the rooftop from the upper step of the ladder.

The rain gutter cleaning is usually carried out manually with use of flower-scoop that moves the debris and leaves gathered therein into the debris dispensing inlet thus to flow into the bucket through the transmission tube thereon. When the debris and leaves in the gutter nearby are cleared, the debris and leaves beyond the cleared points can be gathered with use of the rake by adjusting the length of the fiberglass rod, and when the gutter hanger strap hinders raking, it needs just press the plate rake forward by pushing the rod thereto, thus the spring biased plate rake flattened to allow it pass underneath the hanger strap, and then it is possible to gather the debris and leaves behind the hanger strap. In this way, the roof surface and rain gutters are cleared with the debris, twigs and leaves, the roof surfaces and rain gutters are flushed with water by connecting the female threaded rear end of the fiberglass rod with the water hose by means of manipulating faucet that is located by the rear end portion of the fiberglass rod.

The flushing water is properly controlled for jetting forward or backward, such that when the spring forced plate rake pressed forward and flattened in parallel with the underneath surface, the spouting water running forward, and the plate rake is vertically returned by the biased spring force, the rushing water from the nozzle of the rod is running reverse direction in hitting against the interior wall surface of the plate 5rake.

1-*a*: Debris Inlet Panel

1-*b*: Gutter Holding Panel

1-*c*: Hinge

1-*d*: Grappling Hook

1-*e*: Tapered panel

Figures 1, 2, 3, 4:
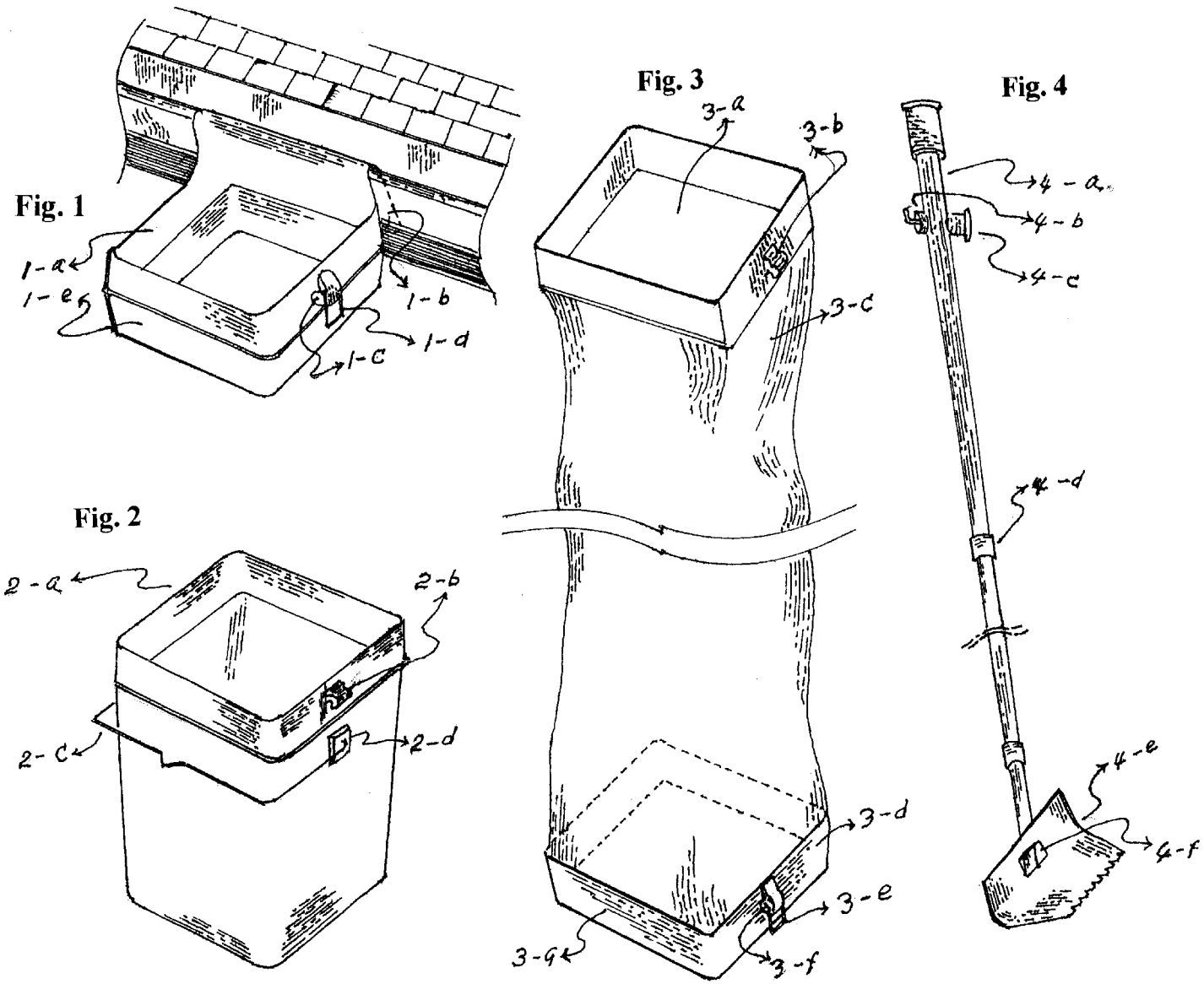
FIG. 1 is a perspective diagonal view of the Debris Dispensing Inlet rectangular having a gutter holding panel in the rear and hooking devices, one on each upper outside of the inlet panel wherein enabling to hook up bucket or debris transmission tube.

FIG. 2 is a perspective view of the Bucket having hook holders, each on upper outside wall and right thereunder having bucket handle stem means wherein the bucket handle is flexibly fixed.

2-*a*: Debris Receiving Bucket

2-*b*: Hook Holder

2-*c*: Bucket Handle

2-*d*: Handle Stem

FIG. 3 is the perspective view of the Debris Transmission Tube having hook holder means disposed each respectively on outside walls of connection panel and having bucket hookup means at the lower end of the transmission tube.

3-*a*: Inlet Connection Panel

3-*b*: Hook Holder

3-*c*: Transmission Tube

3-*d*: Bucket Connection Panel

3-*e*: Grappling Hook

3-*f*: Hook Control Handle-has

FIG. 4 is depicting the perspective view of the Right-angled Plate Rake wherein a pair of axle shoulders are disposed at the right-angle interior base of the plate rake whereby pivotally withheld at the end of the hollow fiberglass rod which having several joints is longitudinally extendible for adjustment of its length while having several joints is longitudinally extendible for adjustment of its length while having female threaded means and faucet at the rear end of the hollow fiberglass rod thus to connect with water hose; having the rectangular nozzle at the forward end of the hollow fiberglass rod with the pivotal axle shoulder horizontally right underneath the nozzle with a twin leg spring thereon.

4-*a*: Hollow Fiberglass Rod

4-*b*: Faucet

4-*c*: Male Threaded Cap

4-*d*: Telescopic Joint

4-*e*: Right Angle Plate Rake

4-*f*: Pivoting Shoulder-has been

Figures 5, 6:
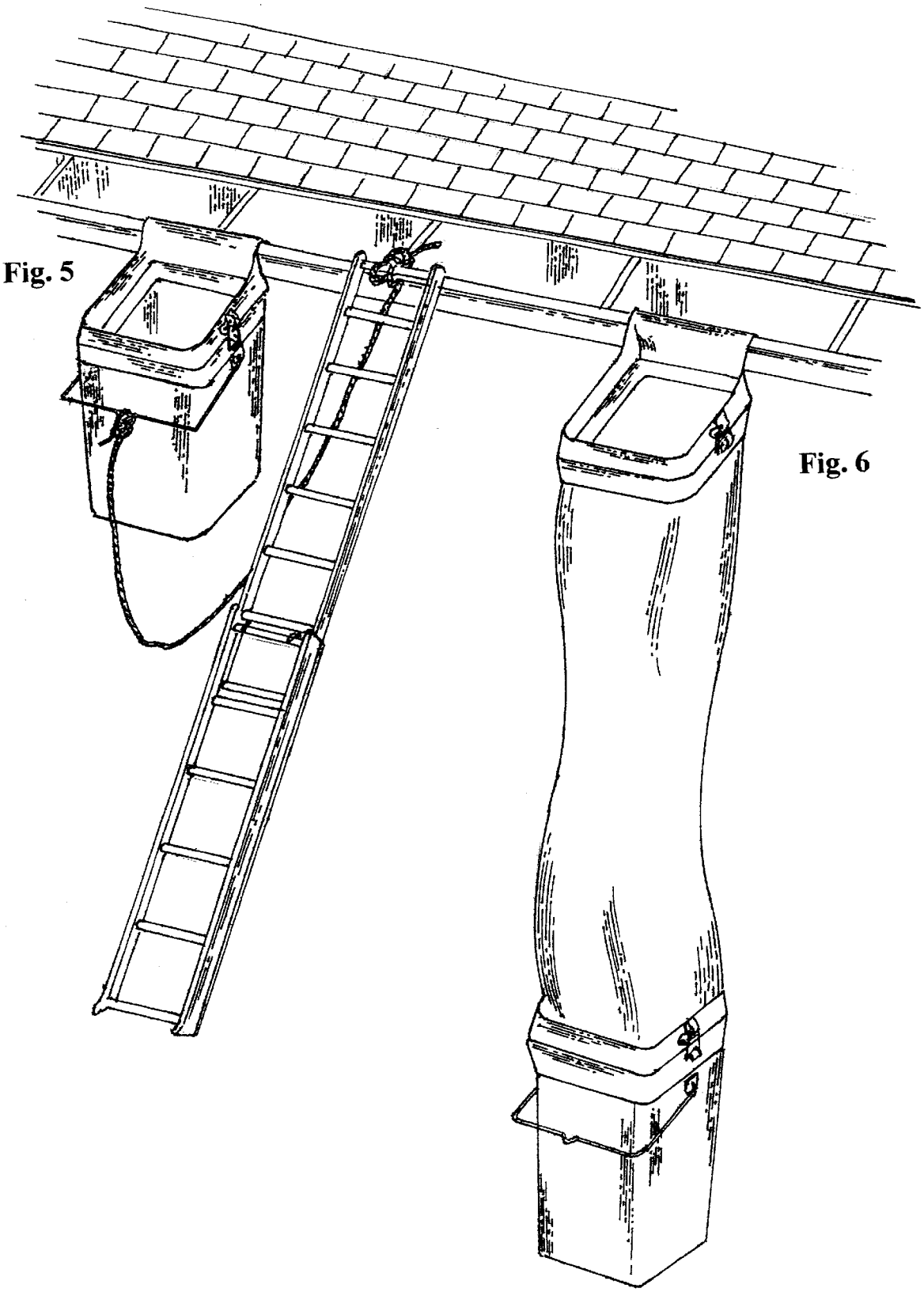

FIG. 5 is the perspective view of the Bucket hooked up and retained by the Debris Inlet Panel while displaying safety use of ladder by tightening topmost step to a gutter hanger strap with use of rope and with another end of the rope tightened with bucket handle.

FIG. 6 is the perspective view of the present invention the form of which is the most normal assembly figure for performance of the roof and rain gutter cleaning job.

Figure 7:
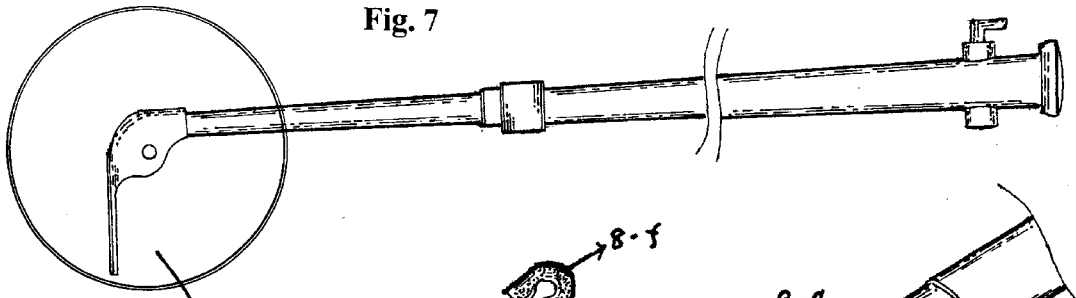

FIG. 7 is elevational side view of the Plate Rake disposed by the end of the hollow fiberglass rod wherein the plate rake is flexibly pivoted and biased by means of a twin-end spring whereby to manipulate water flushing direction forward or backward such that when necessary for flushing straight forward, just push the fiberglass rod forward to have the plate rake biasedly flattened to the underneath surface for the water rushing straight forward, and when slightly lift up the plate rake, then the flushing water hitting the interior wall of the plate rake thus directing it backward that is ideal to washing down the surface of the roof and valley and the rain gutter.

Figure 8:
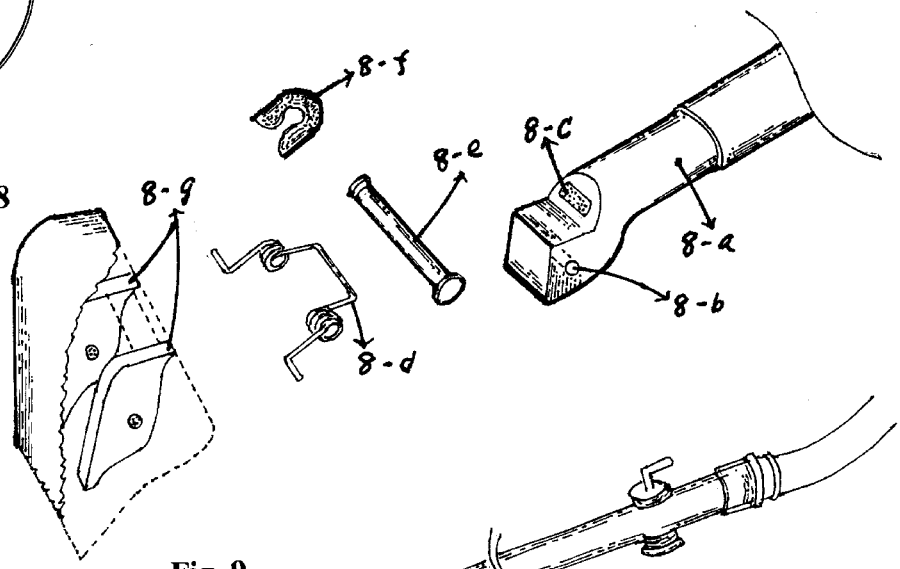

FIG. 8 depicts elevational side view of the Plate Rake with the disassembled parts within the circle which are as follows:

8-*a*. . . molded pivotal shoulder of plate rake

8-*b*. . . horizontal pivot hole

8-*c*. . . flat rectangular nozzle

8-*d*. . . twin-end spring

8-*e*. . . shaft

8-*f*. . . shaft hold pin

8-*g*. . . pair of shaft shoulders

Figure 9:
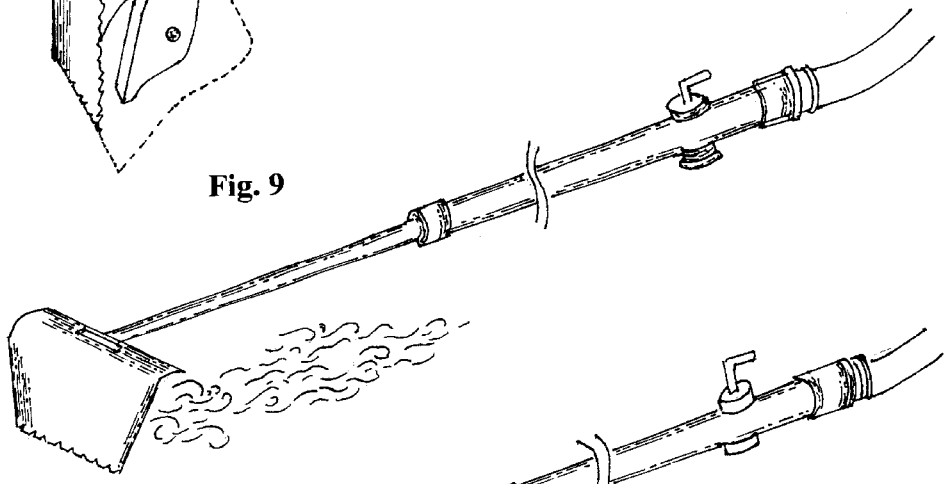

FIG. 9 depicts the Plate Rake appearance when water flushing backward with the rear end of the hollow fiberglass rod connected with water hose.

Figure 10:
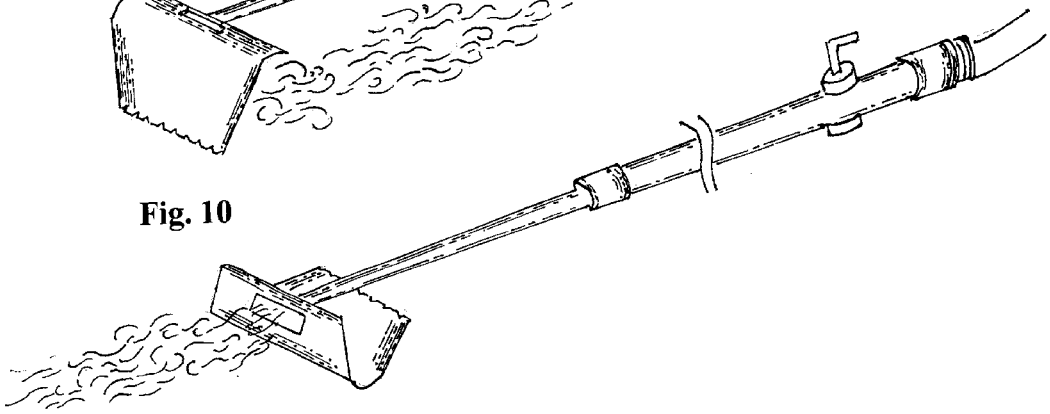

FIG. 10 depicts when water flushing straight forward.

DESCRIPTION OF PREFERRED EMBODIMENT

This invention is to reassure the fact that the rain gutter cleaning should not be separate with cleaning the roof surface, such that the plate rake which is concurrently functioning to water flushing straight forward and backward is significantly incorporated with the debris-leaves dispensing system. When the roof and rain gutters of a house show uncomfortable looking with debris, twigs and leaves, the roof and gutter cleaning job is required to be performed with close observation of the progress wherefore it is necessary to climb ladder which should be safely tightened to an appropriate gutter hanger strap with rope. For cleaning roof and valley, the plate rake depicted in FIG. 4 is operated by adjusting the length of the telescopic hollow fiberglass rod which is extendible by means of several joints from time to time tightening or releasing for adjustment of required length of the hollow fiberglass rod; that is, when relevant joints are clockwisely twisted, they become tightened, and counter clockwise twisting makes release thus to adjust proper length of the hollow fiberglass rod. Since the telescopic hollow fiberglass rod, when maximum extended, is enough to reach the rooftop from the upper step of the ladder, it is possible to clean roof surface and valleys at one location where the ladder is safely set up. When the debris and leaves are gathered from the roof and valley surface down to the rain gutter, the debris dispensing system as depicted in FIG. 6 is set up by the ladder wherein the Debris Dispensing Inlet panel as depicted in FIG. 1 is hanged up by clinging the gutter-holding panel on outer gutter wall. Then, the Tubular Transmission Channel as depicted in FIG. 3 is connected to the Debris Dispensing Inlet panel by means of hook up devices such that the grasping hooks depicted in FIG. 1 (1-*d*) each respectively on the upper panel hook up the Tubular Transmission Channel by means of grasping the hook holders (3-*b*), and in the similar process, the Bucket depicted in FIG. 2 is connected to the lower end of the Tubular Transmission Channel by means of hookup devices.

In order to remove the awkwardly mingled debris and leaves from the rain gutter, it is recommendable to use flower-scoop for manual operation, such that the scooped debris and leaves are put into the debris dispensing channel and flown down to the Bucket at the lower end of the Transmission Tube. When the debris and leaves are cleaned within the span of arm reach, the length of the plate rake is properly extended by readjusting the joints of the hollow fiberglass rod. When cleaning the debris and leaves underneath gutter hanger straps, just push the plate rake forward to bent the spring biased plate rake flatten thus easily pass thereunder whereby to gather the debris and leaves to the points within arm reach for final disposal into the bucket. After series of such cleaning operation, it may be necessary to wash down the surfaces of roof, valleys and rain gutter with use of the specifically designed plate rake which is then transformed water flushing means by connecting threaded rear end of the hollow fiberglass rod to water hose as depicted in FIG. 9 and FIG. 10.

As described above, this invention in combination with the Debris Dispensing System and the Debris Raking and Water Flushing tool is enabled to perform perfect cleaning of roof and rain gutters of a house while keeping the ground surface from contamination several relative elements though, it is easier to assemble and disassemble, and when it is not necessary for debris-leaves cleaning operation, all relative debris cleaning elements and the plate rake with telescopic fiberglass rod could be properly folded and put into the Bucket until next debris-leaves cleaning operation.

I claim:

1. A debris dispensing transmission system comprising:

an inlet element having an inlet opening, an outlet opening and a sidewall, the inlet element having a hook-like portion extending from the sidewall adapted for hanging on outer wall of a rain gutter and two grappling hooks mounted on the sidewall opposite of each other;

a bucket for receiving debris and leaves scooped out from the rain gutter, the bucket having two hook holders near its inlet; and a debris transmission tube having an inlet end an outlet end, the inlet end having two hook holders respectively opposite of each other for coupling with the grappling hooks of the inlet element, and the outlet end having bucket hooking means opposite of each other for coupling with the hook holders of the bucket;

wherein the debris dispensing transmission system can be used selectively in combination such that in a case of excessive debris and leaves accumulation, the outlet opening of the inlet element is detachably connected to the inlet end of the debris transmission tube and the debris transmission tube is detachably connected to the inlet of the bucket, and in a case of small debris and leaves accumulation, the inlet element is directly connected to the inlet of the bucket.

* * * * *